US006198459B1

(12) United States Patent
Rowe

(10) Patent No.: US 6,198,459 B1
(45) Date of Patent: Mar. 6, 2001

(54) ARTIFICIAL POTTED FLOWER AND PLANT RADIO AND TELEVISION ANTENNA

(76) Inventor: James P. Rowe, 477 Bayou Sunset La., Sulphur, LA (US) 70665

( * ) Notice: Subject to any disclaimer, the term of this patent is extended or adjusted under 35 U.S.C. 154(b) by 0 days.

(21) Appl. No.: 09/515,480

(22) Filed: Feb. 29, 2000

(51) Int. Cl.[7] ..... G09F 17/00
(52) U.S. Cl. ..... 343/873; 116/209
(58) Field of Search ..... 343/873; 116/209, 116/28 R, 173; 40/591, 592

(56) References Cited

U.S. PATENT DOCUMENTS 5,836,261 * 11/1998 Sutton ..... 116/209

* cited by examiner

*Primary Examiner*—Don Wong
*Assistant Examiner*—James Clinger
(74) *Attorney, Agent, or Firm*—John D. Gugliotta

(57) ABSTRACT

The present invention is an artificial potted flower and plant television and radio antenna. The antenna is in the shape of a flower pot with flowers in it. The base emulates a flower pot and the antenna ears resemble the stems and petals of flowers. An optional signal amplifier may be installed within the base for improving signal strength.

5 Claims, 3 Drawing Sheets

ARTIFICIAL POTTED FLOWER AND PLANT RADIO AND TELEVISION ANTENNA

RELATED APPLICATIONS

The present invention was first described in Disclosure Document Number 463,608 filed on Oct. 6, 1999. There are no previously filed, nor currently any co-pending applications, anywhere in the world.

BACKGROUND OF THE INVENTION

1. Field of the Invention

The present invention relates generally to television antennas and, more particularly, to an ornamental design for a television antenna embedded in an artificial flower pot.

2. Description of the Related Art

Electronic entertainment appliances such as televisions, radios and home stereo systems are common in just about every household. Their ability to entertain, educate and inform in a realtime manner make them practically indispensable. For those households without a central antenna system or a (CATV) system, the use of an interior antenna, such as a rabbit ear type of antenna, becomes a necessity. While these types of antennas do an admirable job of picking up stations, they are often not very visually appealing. They usually sit on or near the electronic appliance and occupy a great deal of physical space, making it increasingly difficult to decorate. In fact, many users have sacrificed reception performance just to have an installation that is not as visually obtrusive.

Accordingly, there exists a need for a means by which interior-based antenna systems, such as rabbit ears, can be used and installed in a manner that is electrically optimal without making any visual sacrifices that impact the interior decoration of a home. The development of the flexible, artificial potted flower and plant antenna fulfills this need.

Within the related art, numerous applications exist for interior antenna systems for households without a central antenna system or a cable television (CATV) system.

In the related art, the following patents disclose the design and function of a television antenna. These include U.S. Pat. No. 5,943,025 issued in the name of Benham et al., U.S. Pat. No. D 413,892 issued in the name of Lasater, U.S. Pat. No. D 378,592 issued in the name of Hartwig et al., U.S. Pat. No. D 363,489 issued in the name of Geneve et al., U.S. Pat. No. D 306,862 issued in the name of Kent, and U.S. Pat. No. D 158,177 issued in the name of Christianson.

U.S. Pat. No. 4,860,019 issued in the name of Jiang et al. describes a planar television receiving antenna with broad band.

U.S. Pat. No. 4,485,385 issued in the name of Ralston discloses a broadband diamond-shaped antenna.

U.S. Pat. No. 3,995,276 issued in the name of Wolf describes a customized antenna for television or radio with insertable antenna elements.

U.S. Pat. No. 2,978,708 issued in the name of Kuecken discloses center-fed folded dipole antennas.

U.S. Pat. No. D 368,720 issued in the name of Godar describes the ornamental design for a miniature indoor television and FM radio antenna.

While electrically conductive receiving elements, conductors, and connectors are incorporated into this invention in combination, other elements are different enough as to make the combination distinguished over this related art.

Consequently, a need has therefore been felt for an improved but less complex mechanism that provides for great reception of radio frequency signals for televisions or radios without the visual drawback associated with normal set mounted antennas.

SUMMARY OF THE INVENTION

It is therefore an object of the present invention to provide an improved television or stereo antenna which improves incoming radio frequency signals and is disguised to look like a potted plant or flower.

It is a feature of the present invention to provide a flower pot appearance being more visually pleasing than conventional interior antennas and is available in a wide variety of colors, sizes and styles.

It is another feature of the present invention to provide flexible antennas routed inside stems, leaves and flowers of the artificial flowers which can be moved to improve reception.

It is still another feature of the present invention to provide connection to television or stereo with conventional lead-in system.

Briefly described according to the preferred embodiment of the present invention, the flexible, artificial potted flower and plant antenna, as its name implies, is an antenna system for televisions and stereo systems designed to resemble a potted flower. The present invention is designed to sit on the top of either the stereo or television in a manner similar to rabbit ear antennas. The stem, leaves and flowers of the artificial plant are used to hide the actual antenna wiring. The entire invention may be turned or individual stems and branches of the plant may be bent or turned to improve reception and allow for the best incoming signal. The pot container would be made of plastic or ceramic. The invention blends in with most interior decorating schemes and is not visually obtrusive as conventional interior mounted antennas.

In accordance with a preferred embodiment, the pot may be used to house an integral, internal booster amplifier for the amplification of radio frequency signals from stations in fringe areas that are almost out of range.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

Figure 1:
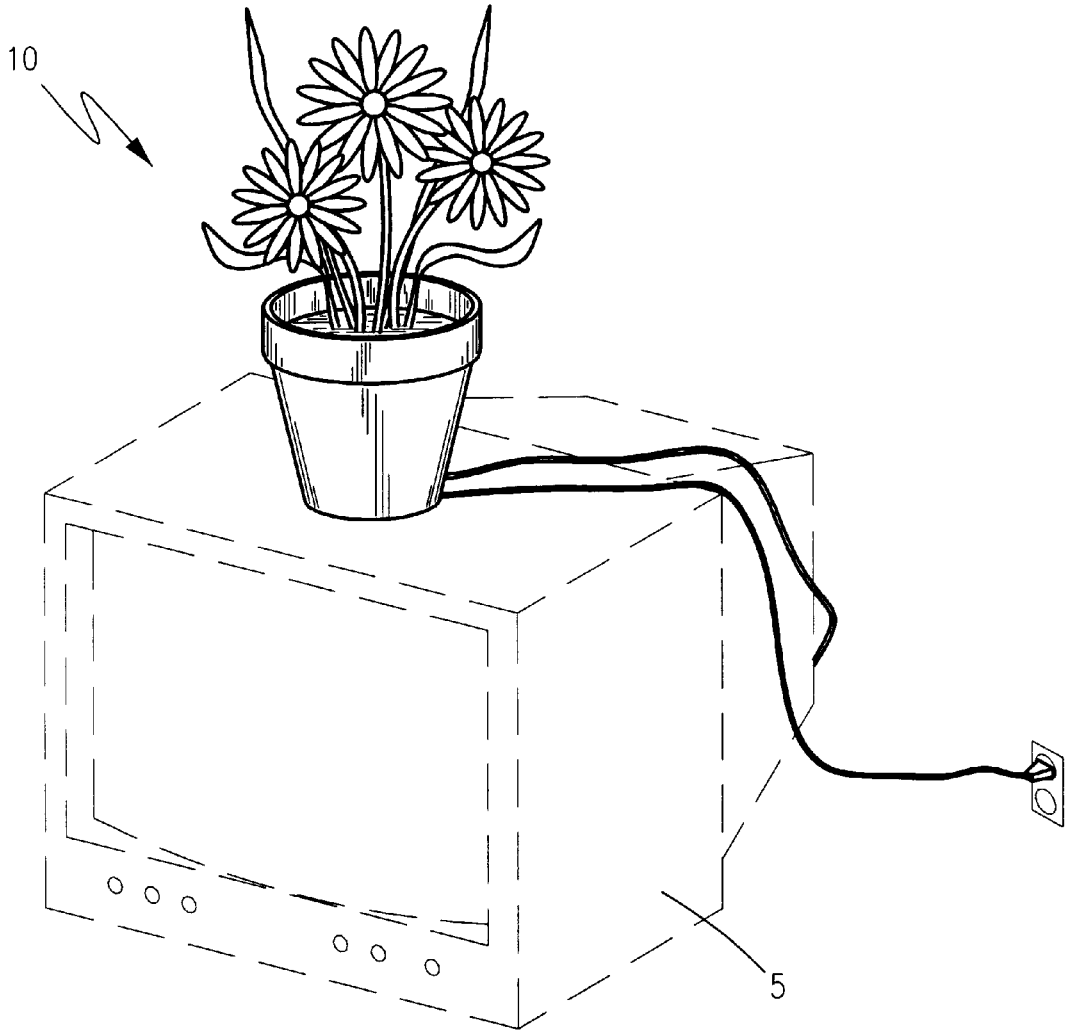
FIG. 1 is a perspective view of the preferred embodiment of a flexible, artificial potted flower and plant antenna in the intended use, according to the preferred embodiment of the present invention.

5 television/radio receiver
10 artificial potted flower and plant radio antenna
11 flexible cover
12 flexible cylindrical elements
21 first end
22 interconnecting means
22*a* conductor
22b conductor
22*c* transmission cable
23*a* first signal bus
23*b* second signal bus
24 second end
30 flower pot
30*a* base
30*b* opening
30*c* inner volume
34 ac power cord
35 power signal booster amplifier
36 flat disc
37 slot
38 cylindrical sidewall
40 connecting means

DESCRIPTION OF THE PREFERRED EMBODIMENTS

The best mode for carrying out the invention is presented in terms of its preferred embodiment, herein depicted within the FIGS. 1–6.

1. Detailed Description of the Figures

Figure 2:
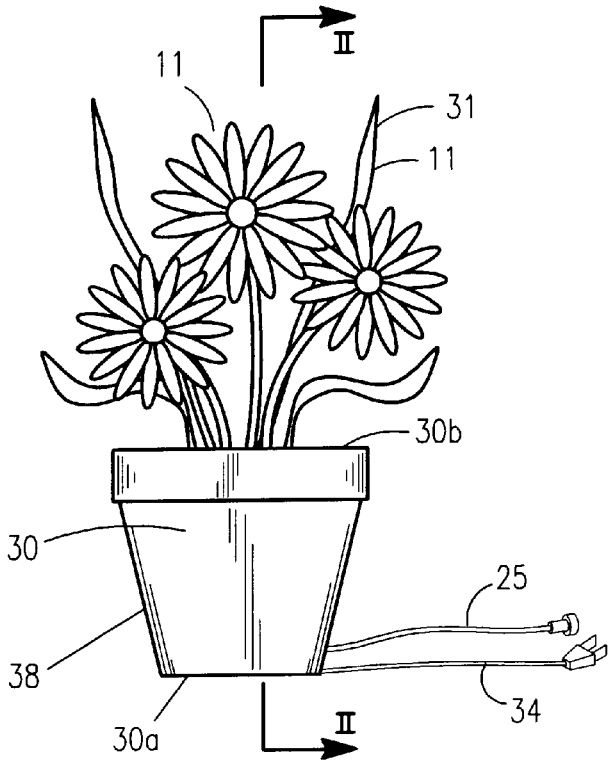
FIG. 2 is a front view of an artificial potted flower and plant television and radio antenna, according to the preferred embodiment of the present invention.
Figure 3:
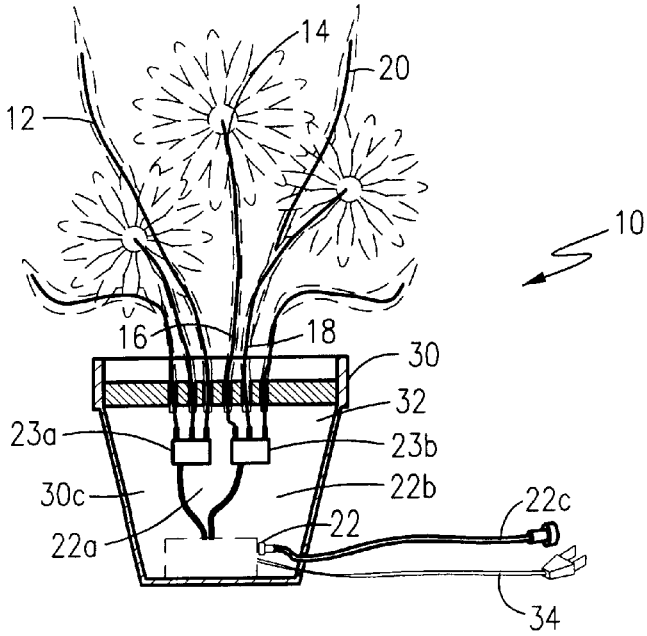
FIG. 3 is a front cross-sectional view taken along lines II—II of FIG. 2 of an artificial potted flower and plant television and plant antenna, according to the preferred embodiment of the present invention.
Figure 4:
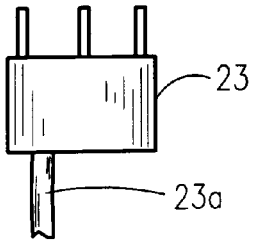
FIG. 4 is a top view of a flat disc showing the slots for holding the flexible cylindrical elements upright from an artificial potted flower and plant television and radio antenna, according to the preferred embodiment of the present invention.
Figure 5:
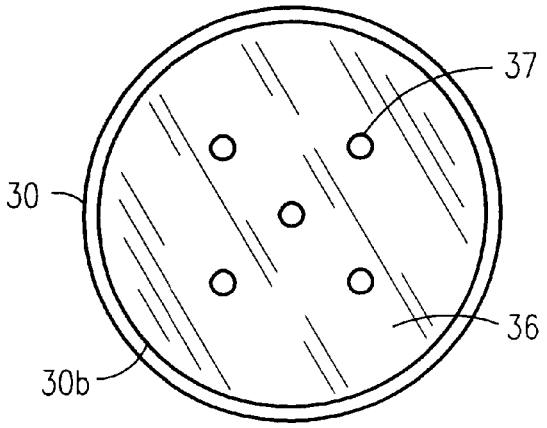
FIG. 5 is a front view of a signal bus for electrically connecting the flexible cylindrical elements to the television or radio receiver transmission cable from an artificial potted flower and plant television and radio antenna, according to the preferred embodiment of the present invention.
Figure 6:
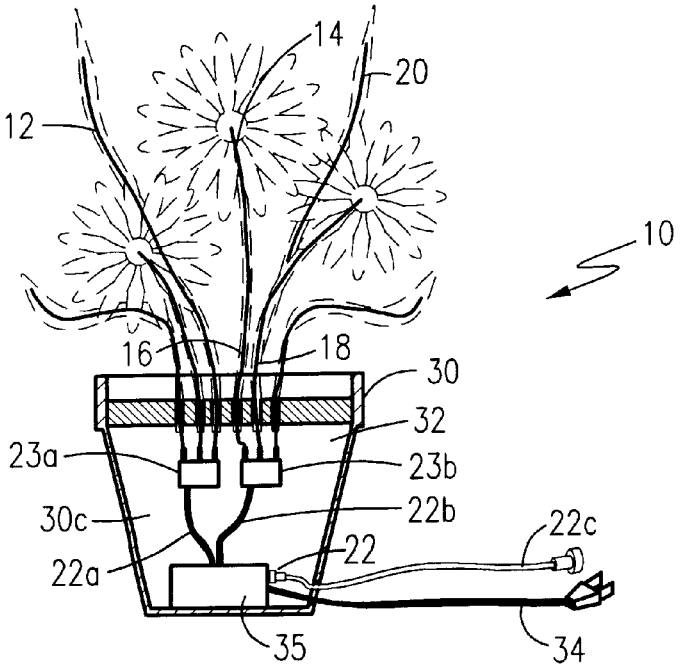
FIG. 6 is a front view of an artificial potted flower and plant television and radio antenna taken along line II—II of FIG. 2 showing the location of the power signal booster amplifier for increasing signal strength, according to the alternate preferred embodiment of the present invention.

Referring now to FIGS. 1 and 2, a potted artificial flower and plant radio and television antenna 10 is shown in its intended use, according to the present invention, comprised essentially of a radio and television antenna tastefully disguised as a flower arrangement in an otherwise conventioanl flower pot. A plurality of signal receiving elements are disguised as the flower stems and petals and are mounted in an electrically non-conductive flower pot 30. The plurality of electrically conductive signal receiving elements are in the form of relatively elongated, flexible cylindrical conduits of respective lengths and indicated, respectively, at 12, 14, 16, 18, and 20. The number of receiving elements 12–20 disclosed is only meant as a suggestion and in no way is limiting on the final number of receiving elements that may be used. The radio and television antenna is designed utilizing well known and existing electronic design technology. A shielded coaxial antenna cable 25 protrudes from the sidewall 38 of and near the bottom of the flower pot 30 for connection to the signal input of a VHF/UHF receiver or radio receiver (not part of the disclosure). In an alternate preferred embodiment, an electrical power cord 34 also protrudes from the sidewall 38 of and near the bottom of the flower pot 30 for connection to a conventional 120 volt ac power outlet. The electrical power cord 34 is for powering a power signal booster amplifier 35 embedded in the bottom of the flower pot 30 for boosting radio and television signal strength.

An electrically non-conductive flexible covering 11 is mounted near the top of each of the plurality of signal receiving elements 12–20. The covering 11, encasing the flexible cylindrical elements, is designed so as to represent the petals and stem of a flower. The flexible cylindrical elements 12–20 are constructed of a flexible, electrically conductive material capable of being bent or turned in various desired positions thereby improving reception and providing for the best incoming signal. In addition, the entire present invention may be turned to improve reception.

The flexible cylindrical elements 12–20, each having a first end 21 opposite end 24, wherein each second end 24 of each of the flexible cylindrical elements 12–20 is secured in a semi-interference type fit manner to a bus 23*a*, 23*b* (to be described in greater detail below) located within an inner volume 30*c* of the flower pot 30. Flower pot 30 is of a generally cylindrical configuration having a vertically oriented cylindrical sidewall 38 forming the sides of flower pot 30, a flat base 30*a* attached at the bottom end of sidewall 38, an enlarged circular opening 30*b* at the upper end of sidewall 38, and wherein sidewall 38 and base 30*a* define the inner volume 30*c* wherein the second end of the flexible cylindrical elements 12–20 are housed and secured therein. The first end of the flexible cylindrical elements 12–20 protrude from the circular opening 30*b* from within inner volume 30*c*. The flat base 30*a* allows for the device 10 to rest upon any flat surface. Flower pot 30 further comprises a flat disc 36 resting horizontally just below the circular opening 30*b* and having ring shapes defining slots 37 therethrough for providing vertical support to the flexible cylindrical elements 12–20. Approximately half of the flexible cylindrical elements are connected to a first signal bus 23*a*, and the remaining flexible cylindrical elements are connected to a second signal bus 23*b*. In the preferred embodiment, flexible cylindrical elements 12–15 are connected to the first signal bus 23*a*, while flexible cylindrical elements 16–20 are connected to the second signal bus 23*b*. First signal bus 23*a* and second signal bus 23*b* are connected to interconnecting means 22, comprised of first and second conductors 22*a* and 22*b*, respectively. The first and second conductor 22*a*, 22*b* are suitably attached via connecting means 40 to a transmission line 22*c*. Transmission line 22*c*, in turn, is connected to the signal input of a VHF/UHF receiver, an FM radio, or the like as previously described.

First bus 23*a* and second bus 23*b*, being constructed of electrically conductive material, such as aluminum, or the like, has a plurality of fittings on the upper surface for receiving in a semi-interference type fit manner each of the flexible cylindrical elements 12–20 and placing each of the flexible cylindrical elements 12–20 in electrical communication with buses 23*a*, 23*b*, respectively.

In order for the present invention to be suitable for effective signal reception not only in a zone of close proximity but for an intermediate zone, the antenna impedance should remain linear over a broad band of frequencies where the impedance corresponds with the receiver. Such linear impedance can be acquired utilizing the flexible cylindrical elements 12–20 having a relatively thick cross section Accordingly, the flexible cylindrical elements 12–20 may be of conventional extruded thin wall aluminum tubing used in conventional antennas, providing sufficient diameter for allowing effective signal reception in intermediate zones. In addition, utilizing extruded thin wall aluminum tubing would provide a cost-affordable means for achieving linear impedance. The aluminum tubing material utilized for acquiring linear impedance as disclosed above is only meant as a suggestion for overcoming the cited problem and in no way is limiting The final design will be chosen after thorough engineering and marketing research. The present invention is available in a wide variety of colors, sizes and styles that blend with any decor and can be placed on top of or near an electronic appliance.

In an alternate preferred embodiment, an integral, internal power signal booster amplifier 35 is positioned inside the flower pot 30 is envisioned for providing amplification of radio frequency signals from stations in intermediate areas almost out of range. Internal booster amplifier 35 is of the type wherein an outside source of energy is used to obtain a gain in signal strength before the signal is sent to the radio receiver. Such amplifiers 35 can be powered by AC or DC current but in the alternate preferred embodiment, the device would be equipped with a plug and power cord for conventional AC power. First signal bus 23*a* and second signal bus 23*b* are connected to power signal booster amplifier 35 via interconnecting means 22, previously described as first and second conductors 22*a* and 22*b*, which in turn are connected respectively, to transmission line 22*c*. Transmission line 22*c*, in turn, is connected to the signal input of a VHF/UHF receiver, an FM radio, or the like as previously described.

2. Operation of the Preferred Embodiment

In operation, the present invention is placed on a level surface such as the top of the television or radio receiver. The coaxial cable protruding from the side of the flower pot is connected to the signal input of a VHF/UHF televison receiver or radio receiver. One now only need to turn on the power of the VHF/UHF receiver or radio receiver. The television receiver or radio receiver is then tuned to the desired station or location. The individual stems and branches of the antenna may be bent into direction to improve reception for the best incoming signal. In the alternate preferred embodiment, the power signal amplifier booster is switched on to improve signal strength in addition to bending the flower stems and branches for the best signal and reception.

The foregoing description is included to illustrate the operation of the preferred embodiment and is not meant to limit the scope of the invention. The scope of the invention is to be limited only by the following claims.

What is claimed is:

1. A potted artificial flower and plant radio and television antenna combination comprising:

an artificial flower having flower stems and petals and mounted in a flower pot;

a plurality of signal receiving elements, each hidden within said flower stems and petals, said signal receiving element of electrically conductive signal receiving elements are in the form of relatively elongated, flexible cylindrical conduits; and a shielded coaxial antenna cable in electrical communication with said signal receiving elements, said cable protruding from and near a bottom of said flower pot, and wherein said shielded coaxial antenna cable is connectable to signal input of a VHF/UHF receiver or radio receiver.

2. The potted artificial flower and plant radio and television antenna combination of claim 1, further comprising:

a power signal booster amplifier embedded in the bottom of said flower pot in communication with both said shielded coaxial antenna cable and said signal receiving elements for boosting radio and television signal strength.

3. The potted artificial flower and plant radio and television antenna combination of claim 1, further comprising electrically non-conductive flexible covering mounted near the top of each of the plurality of signal receiving elements, said covering encasing the flexible cylindrical elements.

4. The potted artificial flower and plant radio and television antenna combination of claim 3, wherein said electrically conductive material is capable of being bent or turned in various desired positions thereby improving reception and providing for the best incoming signal.

5. The potted artificial flower and plant radio and television antenna combination of claim 4, further comprising flexible cylindrical elements wherein each of said flexible cylindrical elements having a first end opposite a second end, said second end is connected in a semi-interference type fit to a signal bus within an inner volume of said flower pot which acts as a support housing for said flexible cylindrical elements, wherein said signal bus is connected to a conductor, said conductor is suitably connected via connecting means to a transmission line, and said transmission line is connected to a signal input of a VHF/UHF receiver or radio receiver.

* * * * *